US008123434B1

(12) United States Patent
Smith

(10) Patent No.: US 8,123,434 B1
(45) Date of Patent: Feb. 28, 2012

(54) INTERLOCKING REVETMENT BLOCK WITH REINFORCED SOCKETS

(75) Inventor: Lee A. Smith, Houston, TX (US)

(73) Assignee: Erosion Prevention Products, LLC, Houston, TX (US)

( * ) Notice: Subject to any disclaimer, the term of this patent is extended or adjusted under 35 U.S.C. 154(b) by 208 days.

(21) Appl. No.: 12/322,449

(22) Filed: Feb. 3, 2009

Related U.S. Application Data

(60) Provisional application No. 61/063,530, filed on Feb. 4, 2008, provisional application No. 61/131,679, filed on Jun. 11, 2008.

(51) Int. Cl.
*E02B 3/12* (2006.01)

(52) U.S. Cl. ..... 405/16; 405/15; 405/17; 405/284; 52/604

(58) Field of Classification Search ..... 405/15–17, 405/262, 282, 284; 52/604, 590.2, 592.2, 52/590.1; D25/113, 114; D21/484
See application file for complete search history.

(56) References Cited

U.S. PATENT DOCUMENTS

| | | | | |
|---|---|---|---|---|
| 3,347,048 | A | 10/1967 | Brown et al. | |
| 3,466,986 | A | 9/1969 | Biller | |
| 4,465,398 | A | 8/1984 | Knudsen | |
| 4,875,803 | A | 10/1989 | Scales | |
| 5,020,938 | A | 6/1991 | Scales | |
| 5,429,451 | A | 7/1995 | Pettee, Jr. | |
| 5,490,363 | A * | 2/1996 | Woolford | 52/604 |
| 5,556,228 | A | 9/1996 | Smith | |
| 5,921,710 | A | 7/1999 | Scales | |
| D415,576 | S | 10/1999 | Scales | |
| 6,276,870 | B1 | 8/2001 | Smith | |
| 6,431,792 | B1 * | 8/2002 | Barnes | 405/25 |
| 6,508,607 | B1 | 1/2003 | Smith | |
| 6,866,446 | B2 | 3/2005 | McAllister et al. | |
| 6,955,500 | B1 | 10/2005 | Smith | |
| 7,037,037 | B1 * | 5/2006 | Smith et al. | 405/20 |
| 7,160,052 | B2 | 1/2007 | Weiss, Jr. et al. | |

* cited by examiner

*Primary Examiner* — David Bagnell
*Assistant Examiner* — Sean Andrish
(74) *Attorney, Agent, or Firm* — Roger N. Chauvza, PC

(57) ABSTRACT

A concrete interlocking revetment block having a pair of arms and a pair of sockets. The arms have enlarged ends and the sockets have enlarged cavities to interlock similar blocks together and prevent lateral separation. The arms extend outwardly from respective side edges of the block, with radial axes orthogonal to each other so as to be adjacent to each other. The sockets are formed into respective side edges of the block, with radial axes orthogonal to each other so as to also be adjacent to each other. The depth of at least one socket is less than the thickness of the block. A portion of the socket is thus covered with concrete to thereby provide reinforcement between adjacent sockets of the block, and reduce incidences of breakage. At least one arm is also formed with a thickness less than the thickness of the block.

18 Claims, 11 Drawing Sheets

INTERLOCKING REVETMENT BLOCK WITH REINFORCED SOCKETS

RELATED APPLICATION

This non-provisional patent application claims the benefit of pending provisional patent applications identified as Ser. No. 61/063,530 filed Feb. 4, 2008 and Ser. No. 61/131,679 filed Jun. 11, 2008.

TECHNICAL FIELD OF THE INVENTION

The present invention relates in general to erosion control blocks, and more particularly relates to interlocking erosion control blocks.

BACKGROUND OF THE INVENTION

The erosion of soil on the earth continues to occur as rain and flood waters run from high elevations to lower elevations. Many efforts have been made to reduce the erosion of soil by interrupting the runoff of water, or at least slow down the water flow and thereby reduce the extent of erosion. Erosion control blocks are available for covering watershed areas to protect the underlying soil from being carried with the runoff water. Many styles, shapes and sizes of erosion control blocks are available for placement together to form a mat that covers the ground to be protected from erosion. The use of erosion control blocks is preferred over the use of a slab of concrete, as concrete can crack and settle if the underlying ground is unstable, which it is in many watershed areas. It is also difficult to make a concrete slab that is adapted to slow down the velocity of water that flows thereover. Erosion control blocks of the articulating type continue to conform to the contour of the ground, even when the ground contour changes.

Blocks that are simply placed side by side on the ground are helpful in reducing soil erosion, but only in situations where the velocity of the runoff water is low or moderate. Otherwise, the hydraulic lift of the flowing water can cause the blocks to actually lift off the ground and be carried or otherwise moved so that the erosion protection is compromised. Of course, the heavier the block the less likely it is to be moved by high velocity water currents. This solution is costly and often prevents the installation of the heavy blocks by persons who must lift each block and place it into position with others to form the mat.

More recently, erosion control blocks have been constructed so as to be laterally interlocking so that horizontal movement is prevented. U.S. Pat. No. 5,556,228 by Smith is an example of a commercially accepted interlocking erosion control block that articulates to conform to the contour of the ground. Such type of block has been accepted by governmental organizations for use on large waterways to halt erosion of the same. Disclosed in U.S. Pat. No. 5,020,938 by Scales is a revetment block that employs a number of cavities and a number of tongues that engage the respective tongues and cavities of neighbor blocks to form a mat. While this arrangement provides some degree of vertical interlocking, the blocks can be freely removed from each other in a lateral direction. The hydraulic stability of such type of block is compromised.

From the foregoing, it can be seen that a need exists for an erosion control block that is both horizontally interlocking as well as vertically interlocking. Another need exists for an erosion control blocks in which a portion of the neighbor blocks overlie each block and prevent hydraulic forces from lifting the block, which otherwise might be displaced by high velocity flood waters. Yet another need exists for erosion control blocks which, when interlocked together, form an interlocking mat that dissipates the energy of the water flowing thereover.

SUMMARY OF THE INVENTION

According to the invention, described is an erosion control block that is both horizontally interlocking as well as vertically interlocking. A feature of the erosion control blocks is that a portion of the neighbor blocks overlie each block and prevent hydraulic forces from lifting the block, which otherwise might be displaced by high velocity flood waters. Another feature of the erosion control blocks is that, when interlocked together, an interlocking mat is formed that dissipates the energy of the water flowing thereover.

According to one embodiment of the invention, disclosed is a mat of three different types of interlocked revetment blocks, which include a first type of revetment block having a body with a thickness defined by a distance between a top surface and a bottom surface of the body of the first type of block. The first type block has a plurality of side edges. The first type block includes at least two arms, where each arm extends from a respective side edge of the body of the first type block. Each arm has an enlarged end connected to a respective side edge by a narrowed neck portion. At least one arm is a partial thickness arm having a thickness less than the thickness of the body of the first type block. At least two sockets are formed inwardly from respective side edges of the body of the first type block. Each socket has an enlarged cavity connected by a narrowed inlet to the respective side edge of the body of the first type block, and the socket is adapted for receiving therein an arm of a similarly constructed neighbor block. At least one socket is a partial depth socket having the enlarged cavity and the narrowed inlet formed with a depth from the top surface to the bottom surface of the block less than the thickness of the body of the first type block. The mat further includes a second type block, where the first type and second type block each have a first thickness. The first type block and the second type block have different configurations of arms and sockets. A third type block has a thickness greater than the thickness of the first and second type blocks. The first, second and third type blocks each have at least one of an arm or socket for interlocking with a respective socket or arm of a neighbor block of the mat. A mat comprising a plurality of the first type blocks, a plurality of the second type blocks and a plurality of the third type blocks are interlocked together.

According to another embodiment of the invention, disclosed is a method of reinforcing a block of the type having arms and sockets. The method includes the operation of forming the block of a heavy material; forming only a pair of arms extending radially outwardly from respective side edges of a body of the block; forming the arms with a radial axis orthogonal to each other; forming one arm having a thickness about the same as a thickness of the body of the block; forming at least one partial depth socket with a depth less than a thickness of the body of the block so that the heavy material covers the socket to a desired depth to thereby provide reinforcement between the sockets; and forming at least one arm as a partial thickness arm with a thickness less than the thickness of the body of the block.

According to another embodiment of the invention, disclosed is a revetment block that includes a body with a thickness defined by a distance between a top surface and a bottom surface of the body of the block, and the block has a plurality of side edges. Included also is a full thickness arm that extends radially outwardly from a first side edge of the block. The full thickness arm has a thickness about the same as the thickness of the block. A partial thickness arm extends radially outwardly from a second side edge of the block, and the second side edge is adjacent the first side edge. A radial axis of the full thickness arm is orthogonal to a radial axis of the partial thickness arm. A full depth socket is formed radially inwardly from a third side edge of the block, and the third side edge is adjacent the second side edge of the block. A partial depth socket is formed radially inwardly from a fourth side edge of the block, and the fourth side edge is adjacent the third side edge of the block. A radial axis of the full depth socket is orthogonal to a radial axis to the partial depth socket. A sum of the thickness of the partial thickness arm and a depth of the partial depth socket is about the same as the thickness of the block. The full thickness arm and the partial thickness arm each have an enlarged end. The full depth socket and the partial depth socket each have an enlarged cavity connected to a respective side edge of the block by a narrowed inlet.

According to yet another embodiment of the invention, disclosed is a mat of revetment blocks that includes a block having a body with a thickness defined by a distance between a top surface and a bottom surface of the body of the block, and the block has a plurality of side edges. The block further includes only two arms, where each arm extends outwardly from diametric opposite respective side edges of the body of the block, and each arm has an enlarged end connected to a respective side edge by a respective narrowed neck portion. The first arm defines a full thickness arm having a thickness substantially the same as the thickness of the block. A second arm has a partial thickness less than the thickness of the block so that the partial thickness arm extends from one surface of the body of the block but not to the other surface of the body of the block. The block further includes only two sockets, where each socket is formed inwardly from diametric opposite respective side edges of the body of the block, and each socket has an enlarged cavity connected by a respective narrowed inlet to a respective side edge of the body of the block. The socket is adapted for receiving therein an arm of a similarly constructed neighbor block. The first socket defines a full depth socket having a depth about the same as the thickness of the body of the block so that the first socket extends from the top surface to the bottom surface of the block. The second socket has a partial depth with the depth extending from one surface of the body of the block but not to the other surface of the body of the block. A first linear row of side by side blocks of the mat is installed by interlocking full depth arms and full depth sockets of the blocks of the linear first row. A second linear row of side by side blocks of the mat is installed by interlocking a partial depth socket of a block of the second row onto a partial thickness arm of a respective block of the first linear row of blocks. A full thickness arm of one block of the second row is interlocked with a full depth socket of a neighbor block of the second row. Each block of the first linear row interlocked with a corresponding block of the second row defines a respective column of the mat, and the rows and columns of the mat are orthogonal to each other.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
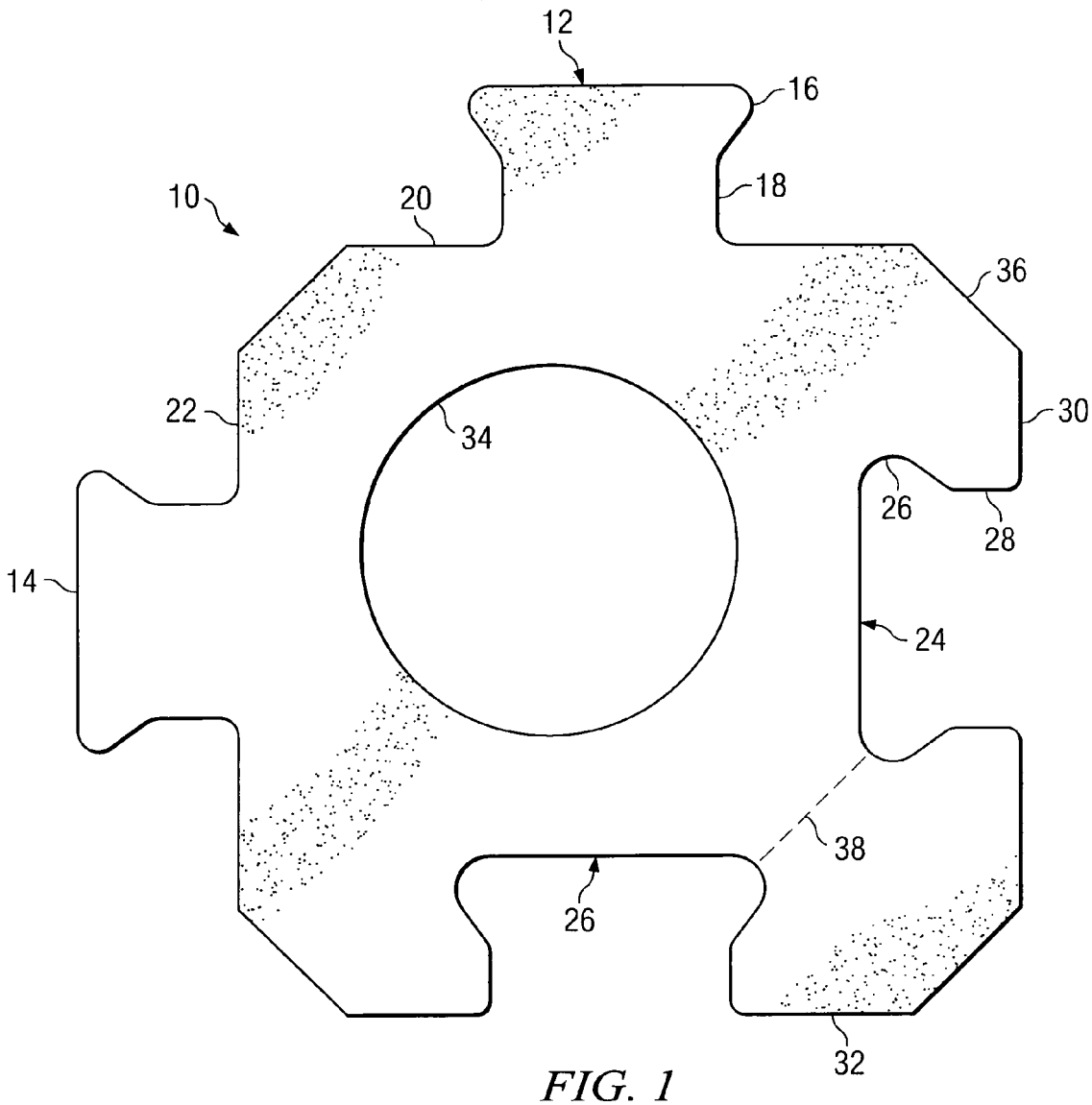
FIG. 1 (PRIOR ART)
FIG. 1 is a top view of an erosion control block well known in the art.

With reference to FIG. 1, there is shown a top view of an erosion control block 10 described in U.S. Pat. No. 5,556,228 by Smith. This erosion control block 10 has been widely used to provide an interlocking block that resists horizontal separation under high hydraulic loads. The block 10 includes a pair of arms 12 and 14. The arms, for example arm 12, includes an enlarged end 16 connected to the side edge of the block 10 by a neck 18. The arms 12 and 14 are formed orthogonal to each other, on respective side edges 20 and 22 of the block 10. The block 10 further includes a pair of sockets 24 and 26. The sockets, for example socket 24, include an enlarged cavity 26 and a narrowed inlet 28. The sockets 24 and 26 are formed orthogonal to each other, in respective side edges 30 and 32 of the block 10. The shape of the sockets 24 and 26 are formed similar to the shape of the arms 12 and 14. However, the sockets 24 and 26 are somewhat larger than the arms 12 and 14 to provide a desired degree of articulation to accommodate irregularities in the surface of the ground upon which a mat of the blocks 10 are laid.

An optional opening 34 is formed through the body of the block 10, from the top surface to the bottom surface thereof. The opening 34 functions to allow grass and other vegetation to grow through the block 10 and assist in anchoring the block 10 to the ground. The block 10 can be constructed with concrete or another heavy material, of various thicknesses, including a standard thickness of four inches. Other situations may dictate that the block 10 be constructed with a thickness of either six or eight inches. However, the block 10 is not limited to any particular thickness or shape. As can be seen in FIG. 1, the revetment block 10 is constructed in an octagonal shape, where the four opposing sides have formed thereon or therein an arm or a socket. The block 10 has angled corners, one shown as reference numeral 36. Thus, with four sides and four angled corners, the block resembles a polygon with eight side edges. While not shown, the revetment, block 10 can be constructed with cable channels therethrough diagonally, or laterally through the center of the block 10 and through an arm 14 and the opposite socket 24, or with a second cable channel through the other arm 12 and to the opposite socket 26.

The revetment blocks 10 are constructed of concrete, preferably by block plant techniques. Although, concrete is a strong and heavy material, which characteristics are desired in a revetment block, there is a disadvantage in the use of the revetment block 10. Through extensive use of the block 10 for commercial purposes, it has been found that during rough handling, or dropping of the block during installation of the same into a mat, the block 10 is subject to breakage.

An area of weakness in the revetment block 10 of FIG. 1 is illustrated by broken line 38. Here, there is a narrowing in the body of the block 10 between the adjacent sockets 24 and 26. It can be appreciated that if the block 10 is dropped on other blocks, or where the bottom right corner of the block shown in FIG. 1 is subject to an upward or downward force, the corner can be broken off the block 10 along line 38. It can be further appreciated that when a block is broken, it must be replaced. This can be an expensive procedure in replacing a broken block in a mat, especially if the mat is cabled together. In addition, the loss of any block 10 due to breakage during shipping or otherwise, means that the replacement thereof represents an economic loss to the manufacturer.

Figure 2:
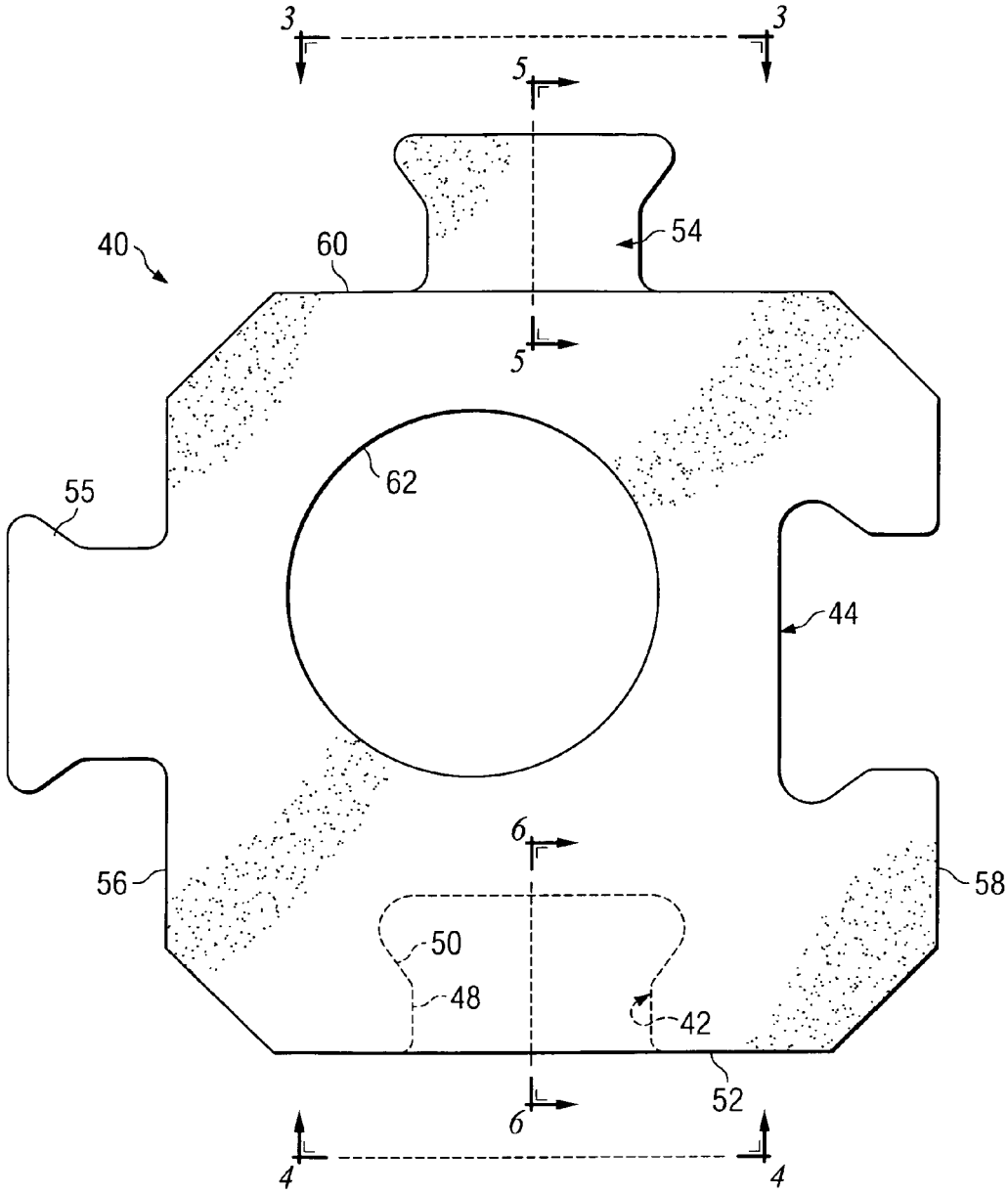
FIG. 2 is a top view of an erosion control block constructed to provide reinforcement between adjacent sockets.

According to an important feature of the invention, a modified revetment block 40 shown in FIG. 2 is strengthened to provide additional support between the adjacent sockets and thereby reduce the incidences of breakage. The improved block 40 is constructed much like the block 10 of FIG. 1, but includes a modified socket 42 that is not formed entirely through the block 40. Rather, the socket 42 is formed only partially through the body of the block 40. The socket 42 extends from the bottom surface of the revetment block 42 upwardly, but not to the top surface of the block 40 like the prior revetment block 10 of FIG. 1. In one embodiment, the modified socket 42 extends about half way through the block 40, meaning that the depth of the socket 42 is about half the thickness of the block. This is believed to adequately strengthen the revetment block 40 between the adjacent sockets 42 and 44. The thickness of the body of the block is the dimension between the top surface and the bottom surface of the body. In the preferred embodiment, the other adjacent socket 44 includes a full depth from the bottom surface of the block to the top surface, much like the sockets 24 and 26 of the FIG. 1 block.

Figure 4:
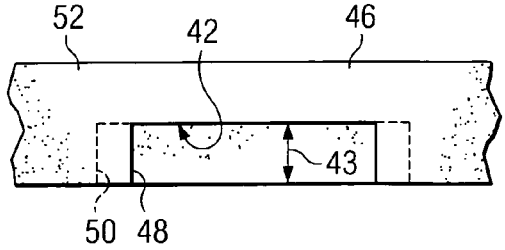
FIG. 4 is a side view of the modified socket the block of FIG. 2, taken along line 4-4 thereof.
Figure 6:
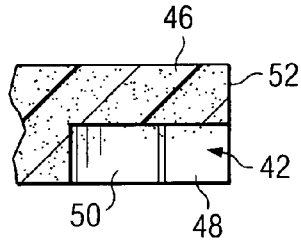
FIG. 6 is a partial cross-sectional view of the modified socket of the block of FIG. 2, taken along line 6-6 thereof.
Figure 8:
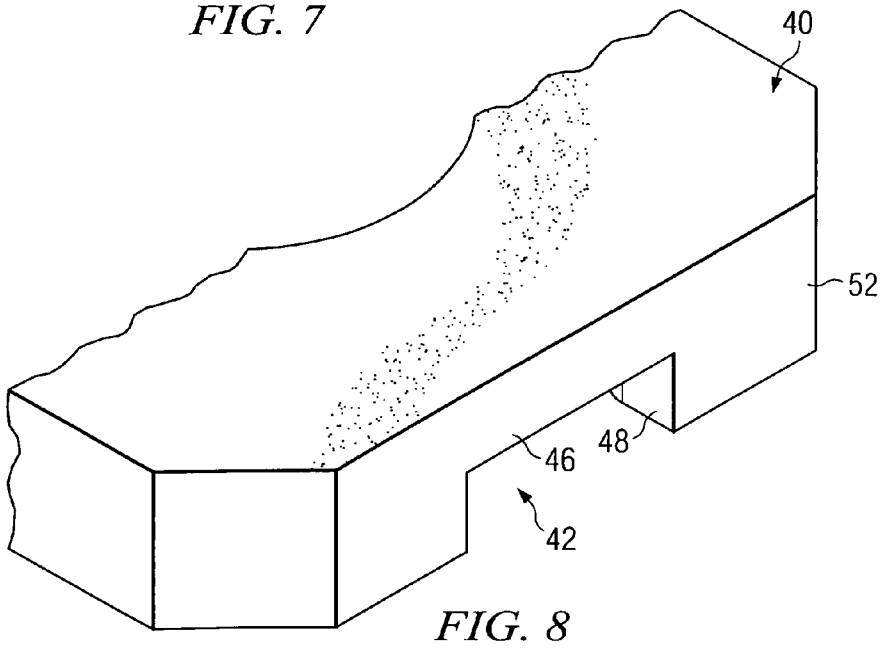
FIG. 8 is an isometric view of a portion of the interlocking revetment block of FIG. 2, illustrating the modified socket constructed according to an embodiment of the invention.

FIGS. 4 and 6 illustrate respective side and cross-sectional views of the modified, or partial depth socket 42. The top portion of the block 40 is filled in over the socket 42 and covers the same. The socket cavity occupies the bottom portion of the block 40. The additional material 46 above the socket 42 provides strength to support additional loads to which the corner of the block 40 can be subjected during handling and/or dropping of the block 40. It is noted that the shape and size of the socket 42 according to this embodiment is substantially the same as that described above in connection with the block of FIG. 1. In other words, the socket 42 includes a narrowed inlet 48 between the side edge 52 of the block 40 and an enlarged cavity 50. The narrowed inlet 48 is illustrated in the isometric view of FIG. 8. As will be described below, a reduced-thickness arm 54 is formed on the block 40 for fitting in an interlocking manner into the reduced-depth socket 42. It is noted that the half-depth socket 42 is centered between opposing side edges 56 and 58. The sockets 42 and 44 formed in the block 40 have radial axes orthogonal to each other. The depth of the partial depth socket 42 is indicated with arrowed line 43 in FIG. 4.

Figure 3:
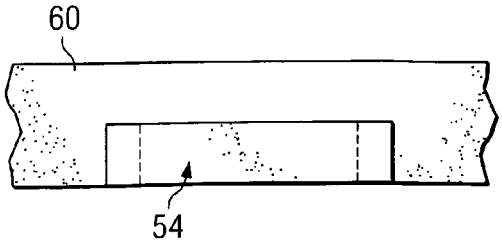
FIG. 3 is a partial side view of the modified arm of the block of FIG. 2, taken along line 3-3 thereof.
Figure 5:
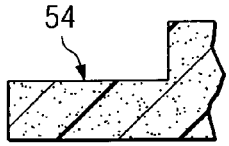
FIG. 5 is a partial cross-sectional view of the modified arm of the block of FIG. 2, taken along line 5-5 thereof.
Figure 7:
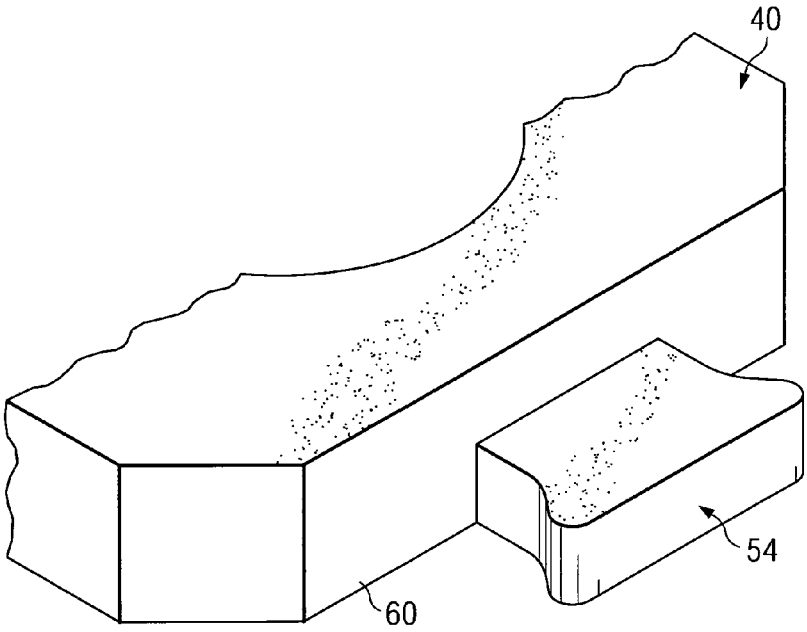
FIG. 7 is an isometric view of a portion of the interlocking revetment block of FIG. 2, illustrating the modified arm constructed according to an embodiment of the invention.

As a result of the formation of a partial depth socket 42, the block 40 constructed according to the invention includes a partial depth arm, shown as numeral 54 in FIG. 2. The arm is formed with a shape substantially the same as that of the arm 12 shown in FIG. 1. However, the arm 54 has a depth about half the thickness of the block 40. Thus, for a conventional four inch thick block 40, the arm 54 has a depth of about two inches. A side view of the partial thickness arm 54 is illustrated in FIG. 3, and a cross-sectional view is illustrated in FIG. 5. An isometric view of the half-thickness arm 54 is illustrated in FIG. 7. The arm 54 extends outwardly from the side edge 60 of the block 40.

In order for the half-thickness arm 54 of one block 40 to fit within the half-depth socket 42 of a neighbor block 40, the arm 54 is formed to extend from the bottom half of the block 40 to fit within the socket 42 which is also formed in the bottom half of the block 40: In this manner, neighbor blocks of the invention can be interlocked together by simply lowering a block so that the half-depth socket 42 thereof is lowered over and engaged with the underlying half-thickness arm 54 of another block. The other arm 55 of the block 40 is a conventional full thickness arm. The arms 54 and 55 have radial axes orthogonal to each other. The installation procedure will be described in more detail below.

The revetment block 40 is constructed with an opening 62 formed through the block 40, from a top surface to a bottom surface thereof. A conventional full thickness arm 55 is formed adjacent the half-thickness arm 54. A conventional full depth socket 44 is formed in the side edge 58 of the block 40 adjacent the half-depth socket 42. Much like the conventional revetment block 10 shown in FIG. 1, the modified revetment block 42 includes angled corners to define an octagonal-shaped revetment block 40. The opening 62 is centered within a rectangular outline or footprint of the block 40. Because of the partial thickness arm 54 and the partial depth socket 42, the block 40 is preferably constructed using a mold and pouring therein the wet concrete. When constructing the block 40 using a mold, the various side edges would have a slight angle or draft to facilitate removal from the mold.

Figure 9:
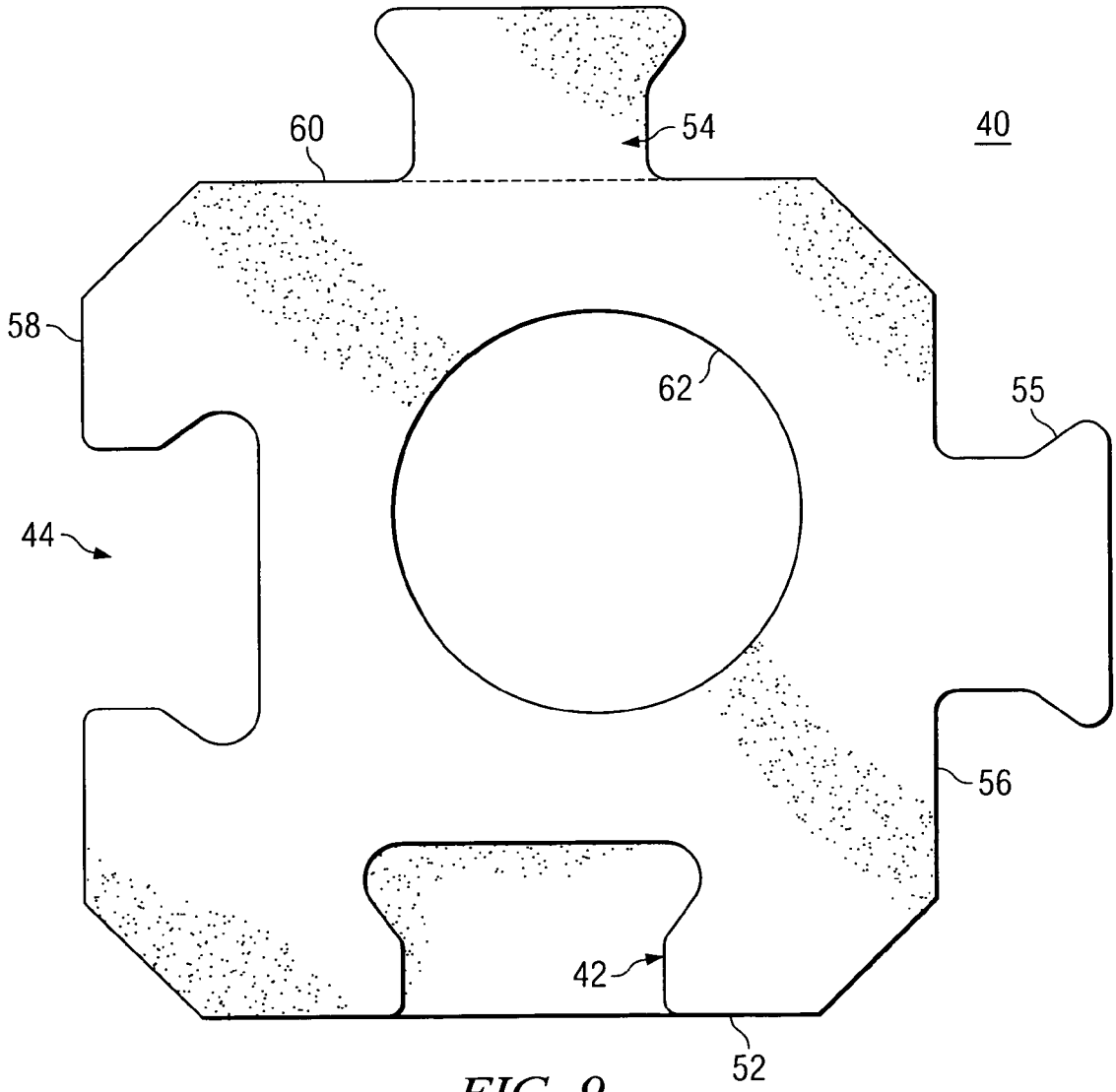
FIG. 9 is a bottom view of the revetment block of FIG. 2.

Referring now to FIG. 9, there is shown the bottom of the modified revetment block 40 of FIG. 2. The block 40 includes a full-thickness arm 55 and a full-depth socket 44. As described above, the block 40 includes the half-depth socket 42 in which the cavity is shown. The half-thickness arm 54 is also shown, although the half that is absent is formed on the top half of the block 40.

Figure 18:
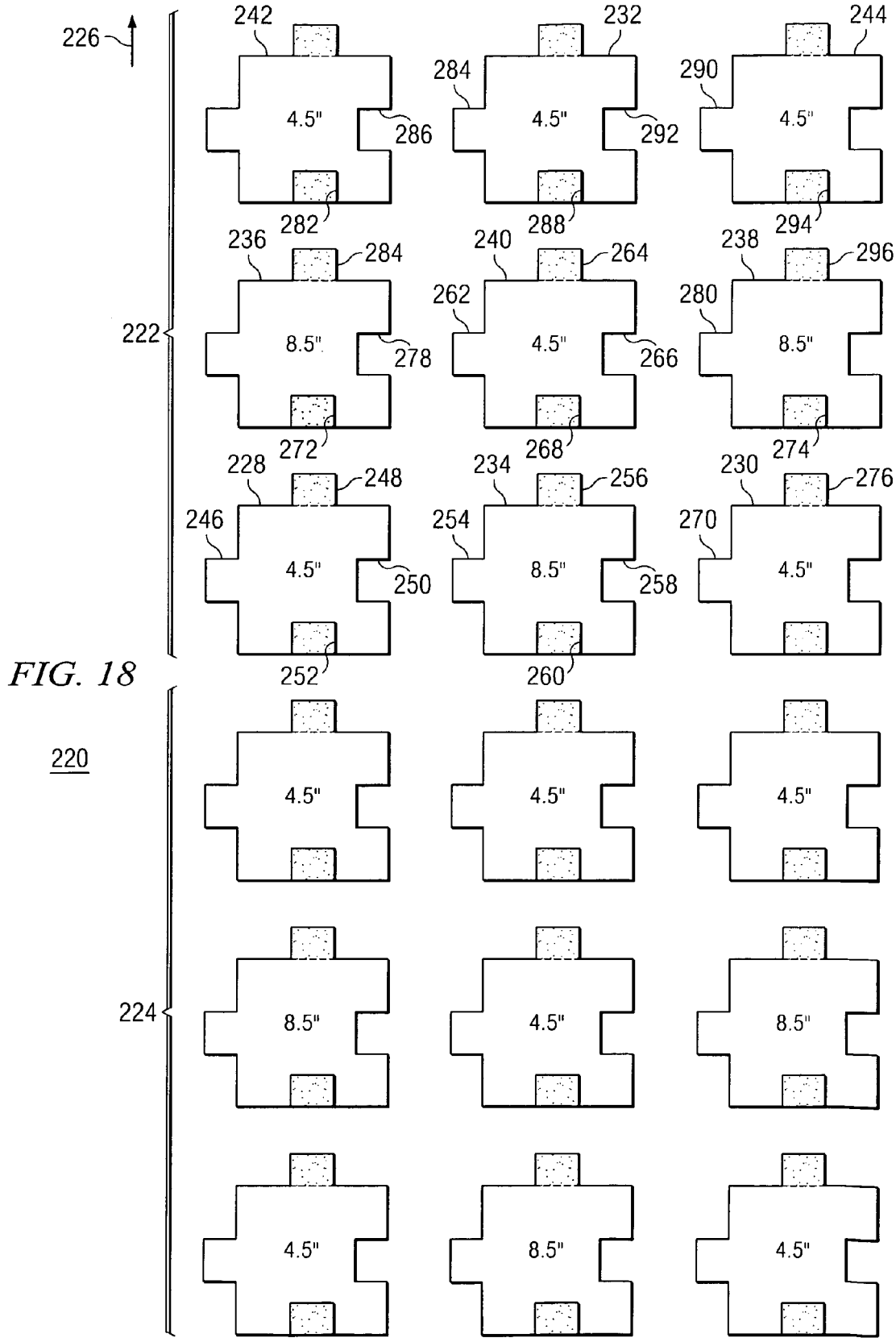
FIG. 18 is yet another embodiment of a mat of erosion control blocks employing different thicknesses blocks to provide energy dissipation to water flowing thereover.

According to another embodiment of the invention, the revetment block 40 can be laid on the ground with the bottom thereof facing upwardly, as shown in FIG. 9. In other words, during installation the half-depth socket 42 faces upwardly, and the half-thickness arm of a neighbor block in laid downwardly into the upwardly facing half-depth socket 42 of the block 40. With this arrangement, the block with the partial thickness arm would be installed upstream from the neighbor block. A mat of blocks installed according to this embodiment is illustrated in FIG. 18. In this and other embodiments described herein, the thickness of the revetment block can be about 4.5 inches, with the thickness of the partial thickness arm being about 3.25 inches, and the depth of the partial depth socket also being about 1.25 inches. The additional portion 46 of the block would thus be about 3.25 inches thick. It may be found that the partial thickness arms of the erosion control block can be made stronger by making them greater than half the thickness of the block 40, and making the depth of the partial depth sockets correspondingly smaller.

Figure 10:
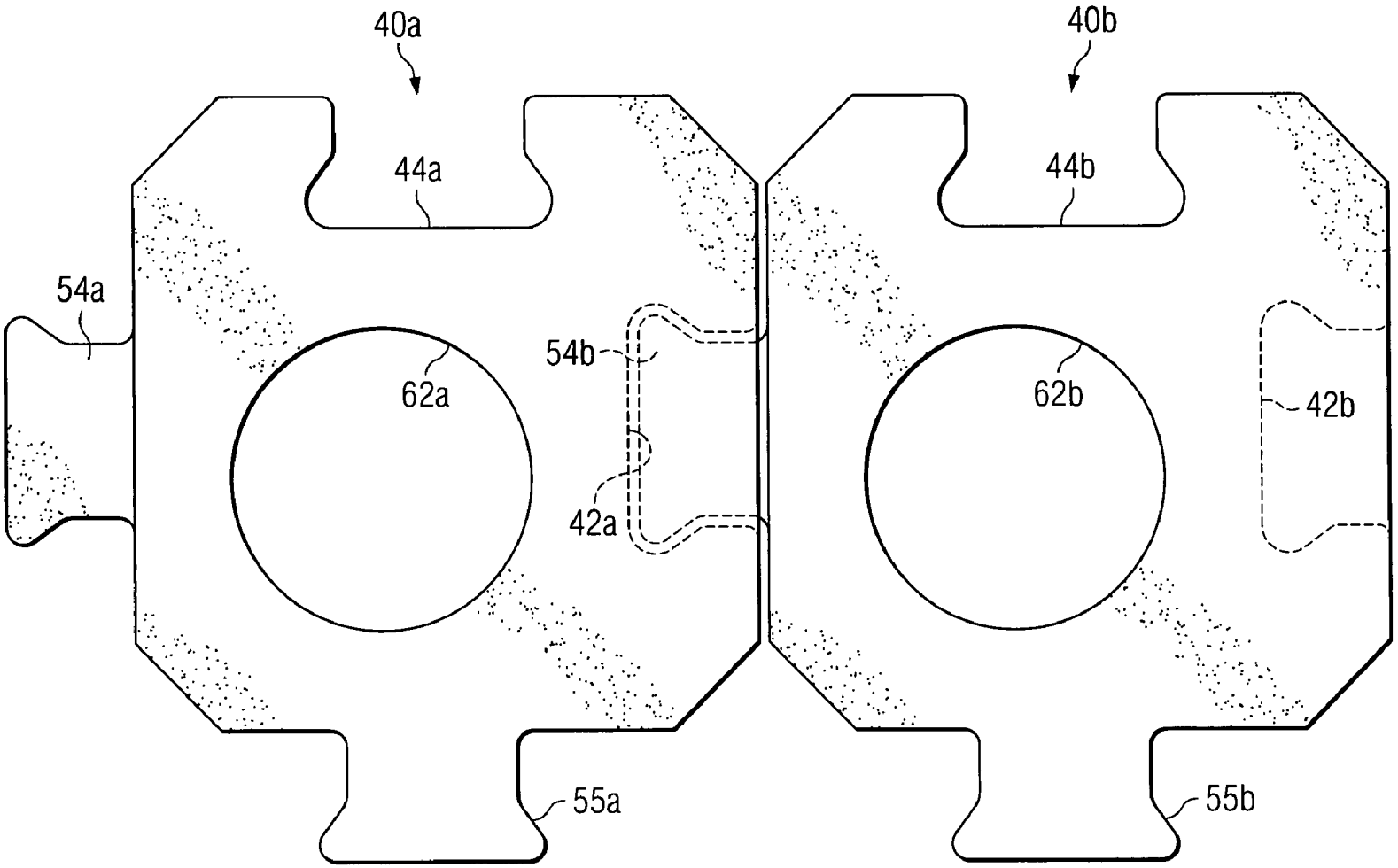
FIG. 10 is a top view of two revetment blocks of the invention, shown interlocked to provide horizontal and vertical interlocking capabilities.

FIG. 10 illustrates a pair of modified blocks 40*a* and 40*b* interlocked together. First, the block 40*b* is laid on the surface to be protected from erosion. The bottom of the block 40*b* is on the ground, with the half-thickness arm 54*b* also in contact with the ground. A neighbor block 40*a* is then oriented as shown, and the half-depth socket 42*a* is lowered onto and into engagement with the half-thickness arm 54*b* of block 40*b*. With the orientation as shown, the second block 40*a* is oriented so that the half-depth socket 42*a* faces downwardly. It can be seen that the large area of concrete that covers the top half of the half-depth socket 42*a* provides additional strength between the adjacent sockets 44*a* and 42*a*, and reduces the likelihood of breakage. As can be appreciated, when the enlarged end of the half-thickness arm 54*b* of one block 40*b* is inserted into the enlarged opening of the half-depth socket 42*a* of the other block 40*a*, the blocks are horizontally interlocked and cannot be laterally removed from each other. An additional advantage of the interlocking arrangement between the half-thickness arm 54*b* of one block 40*b* and the half-depth socket 42*a* of the other block 40*a*, is that the block 40*b* is vertically interlocked. With this arrangement, the half-thickness arm 54*b* of block 40*b* is held down by the material 46 (FIGS. 4 and 8) that covers the top of the half-depth socket 42*a*. As such, when a number of blocks 40 are installed in the interlocking manner noted above, there is both a horizontal and vertical interlocking arrangement. In addition, each of the blocks of the interlocked mat are stronger and less susceptible to breakage. In the event that the erosion control block is installed with the partial depth sockets facing upwardly, then the illustration of FIG. 10 would be a bottom view of the two neighbor blocks 40*a* and 40*b*.

Figure 11:
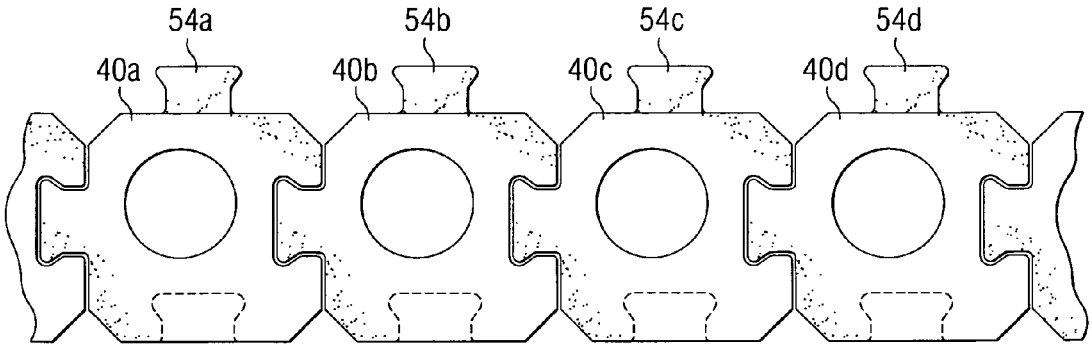
FIG. 11 is the starting row of a mat of revetment blocks installed according to the invention.
Figure 12:
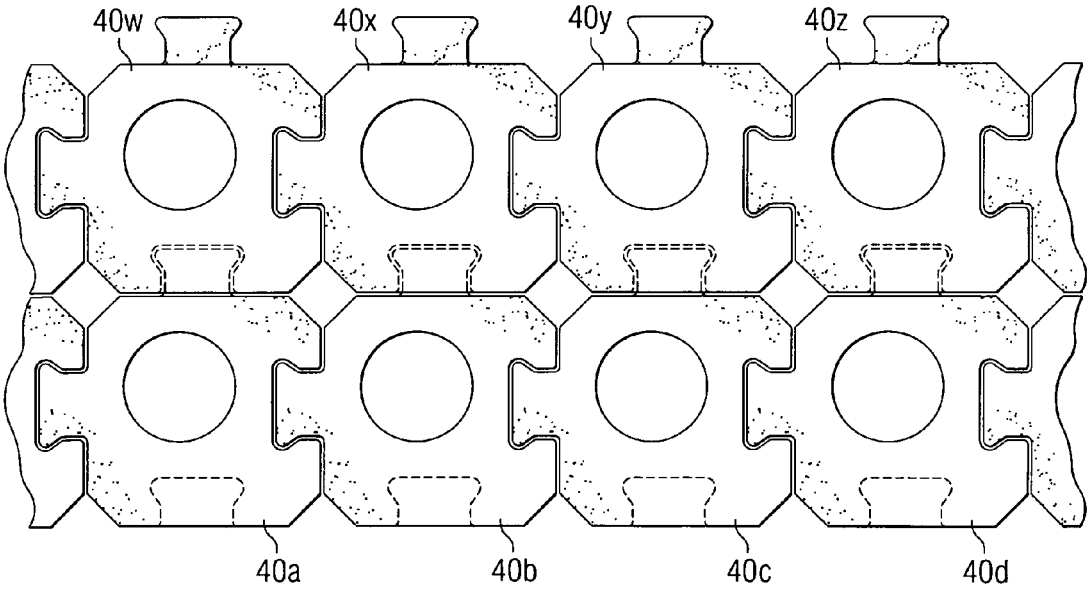
FIG. 12 illustrates the sequence of installing blocks interlocked to the starting row.

The installation of the modified revetment blocks 40 is better understood by referring to FIGS. 11 and 12. A first row of blocks 40*a*-40*d* is laid on the ground in the area to be protected from erosion. In practice, the blocks 40 can be laid on a synthetic woven fabric covering the ground. As can be seen, in the first row, the blocks 40*a*-40*d* are interlocked using the full arms 55 engaged within the full sockets 44 of the neighbor blocks. Preferably, the first row of blocks is installed and oriented on the ground so that the half-depth arms 54*a*-54*d* point in an upstream direction.

The next row of blocks, which include blocks 40*w*-40*z* of FIG. 12, are interlocked with the first row of blocks 40*a*-40*d*. The second row of blocks 40*w*-40*z* can be installed, starting from either the right or left of the first row. Each block of the second row 40*w*-40*z* is oriented so that the full arm 55 faces to the left (as depicted in FIG. 12) and the half-depth socket 42 is over the half-thickness arm 54 of the block in the first row to be interlocked therewith. Each block of the second row 40*w*-40*z* is lowered onto the half-thickness arm 54 of the first row blocks 40*a*-40*d* in the manner described until installation of the second row of blocks is completed. Each subsequent row of blocks is installed in the same manner as described above in connection with the second row 40*w*-40*z*. An entire mat or section of erosion control blocks can thus be formed. Moreover, when the blocks are installed with the half-thickness arms pointed upstream, the sides of the blocks to which the half-thickness arm is attached is held down by the half-depth socket of the upstream neighbor block. The tendency of water running downstream to hydraulically lift blocks is thus reduced, as the modified block of the invention is vertically interlocked and prevented from being lifted by the adjacent upstream block.

Figure 13:
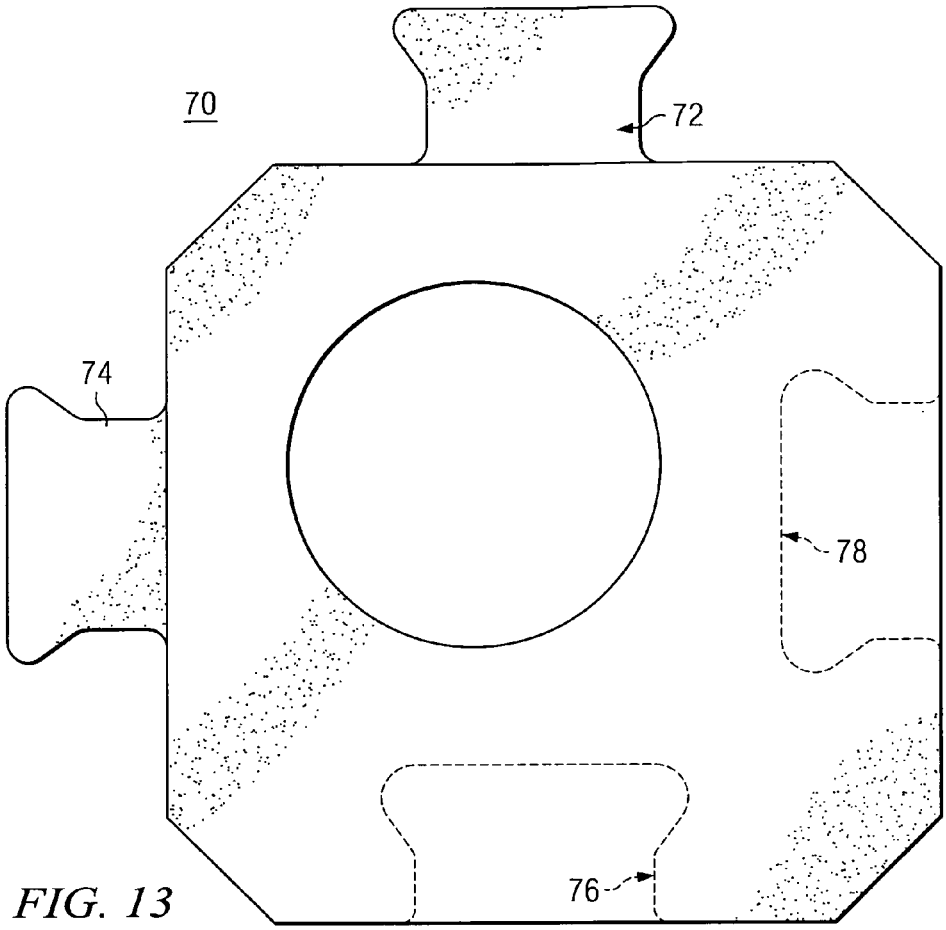
FIG. 13 is a top view of an interlocking revetment block constructed according to another embodiment of the invention, with two modified arms and two modified sockets.

FIG. 13 illustrates a modified revetment block 70 constructed according to another embodiment of the invention. The modified block 70 includes a first half-thickness arm 72 and an adjacent, second half-thickness arm 74. Further included is a first half-depth socket 76 and a second, adjacent half-depth socket 78. In other words, the block 70 is constructed much like the modified block 40 of FIG. 2, except all arms are fabricated in the same orientation and as half-thickness arms, and all sockets are fabricated with the same orientation and as half-depth sockets.

Figure 14:
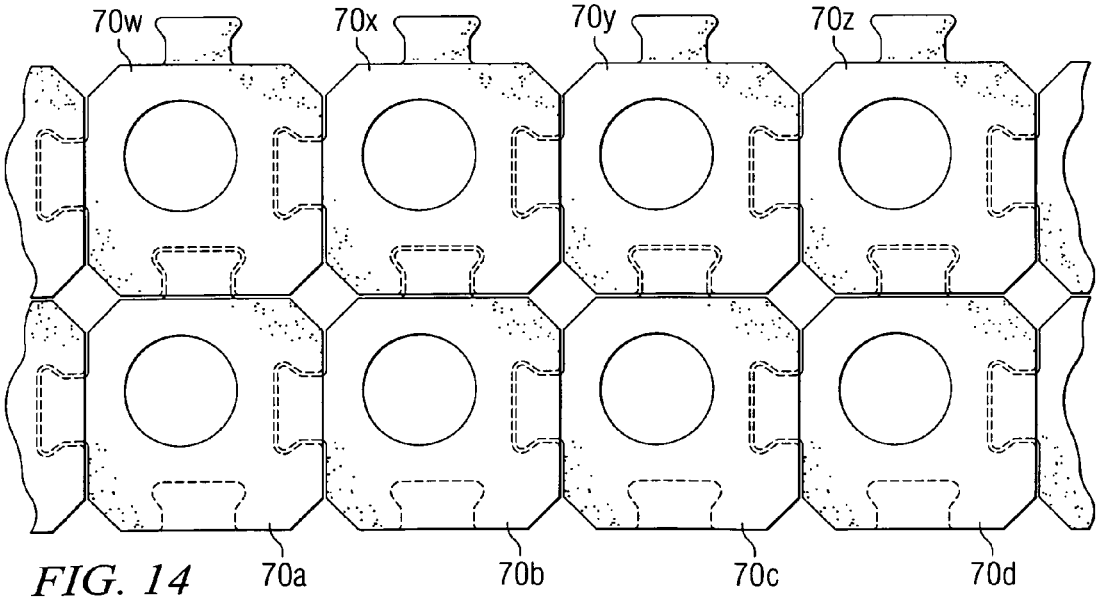
FIG. 14 illustrates the sequence of installing blocks of the type shown in FIG. 13.

The installation of the revetment block 70 is somewhat more complicated than the block 40 shown in FIG. 2. Two rows of modified revetment blocks 70*a*-70*d* and 70*w*-70*z* are illustrated in FIG. 14. As can be appreciated, the vertical interlocking capability of the revetment block 70 is twice that of the block 40 of FIG. 2. Two half-thickness arms of each block are held down by a respective half-depth socket of two other neighbor blocks. The installation of the modified revetment block 70 is somewhat different from that of the block 40, in that after the first row of revetment blocks 70*a*-70-*d* is laid down, the next row of revetment blocks 70*w*-70*z* must be sequentially laid down from the right to the left in FIG. 14. Otherwise, the half-thickness arm of the block to be next laid down in the second row would have to be slid under the half-depth socket of the neighbor block in that row. In any event, it is preferred that the blocks 70 be oriented in the same manner noted above so that the direction of flow of water does not tend to lift the blocks.

In order to facilitate a greater degree of articulation of one block with respect to an adjacent interlocked block, a portion of the top surface of a half-thickness arm can be angled downwardly toward the outer edge of the arm so that the arm (and corresponding block) can pivot or articulate about a horizontal axis to a greater degree within a half-depth socket.

As noted above, for a four-inch thick revetment block, it is envisaged that the depth of a half-thickness arm can be about two inches, and the depth of a half-depth socket can also be about two inches. For an eight inch thick revetment block, the modified arm can be about six inches thick, and the modified socket can be about six inches in depth. While the thickness of the arm and the depth of the socket are noted above as being of specified dimensions, those skilled in the art may find that other modified arms and sockets can be fabricated with dimensions other than noted above. While the revetment blocks disclosed above are constructed with arms on respective side edges of the block, and a respective cavity on a side edge of the block opposite an arm, this is not a necessity. Those skilled in the art may find it advantageous to construct the revetment block with arms opposite each other, and cavities opposite each other. However, this block configuration is more difficult to install as an interlocking mat.

As described above, the interlocking erosion control blocks can be constructed with different thicknesses for use in different situations to achieve the benefits of hydraulic stability, cost, ease of installment, etc. According to an important feature of the invention, blocks of different thicknesses can be employed together to form a mat with thinner and thicker blocks to provide energy or flow dissipation capabilities for water flowing over a mat having an irregular surface contour.

Figure 15:
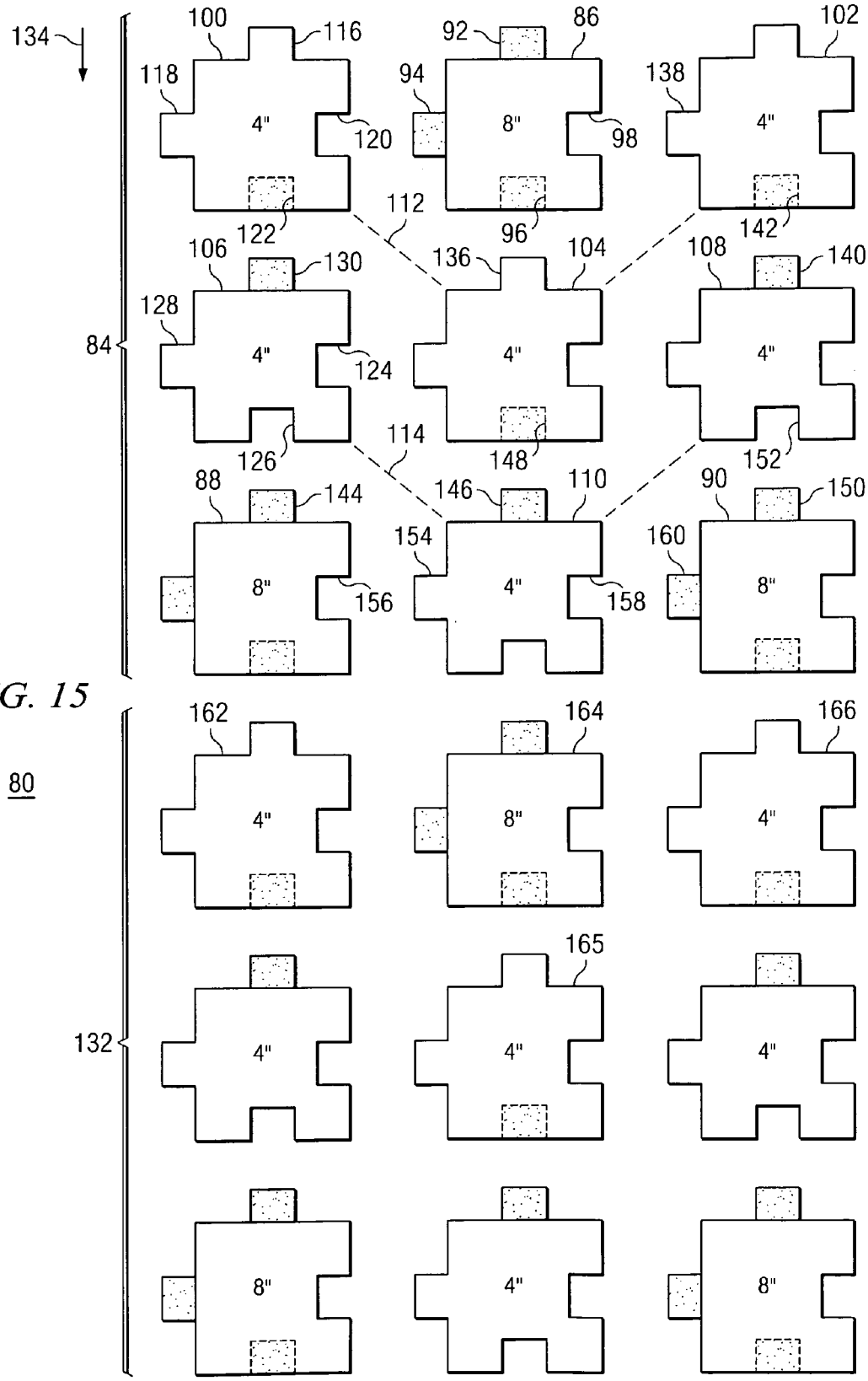
FIG. 15 is a mat of erosion control blocks employing blocks of different thicknesses interlocked together to provide a high degree of hydraulic stability.

FIG. 15 illustrates a mat 80 of erosion control blocks well adapted for use as the floor or bed of a flume to dissipate the energy of water flowing down the grade of the flume. The individual blocks illustrated in FIG. 15 are shown in simplified form, it being realized that the arms and sockets are structured to provide horizontally interlocking between neighbor blocks. The interlocking arms and sockets can be shaped like those described above, or can be other shapes adapted to provide a horizontal interlocking relationship therebetween. Moreover, some of the arms and sockets are formed with a half depth through the respective blocks, as described above in connection with FIGS. 2-8, to provide vertical interlocking capabilities with neighbor blocks. While not shown, the locks of the mat 80 can be constructed with openings therethrough for the growth of vegetation.

The partial mat 80 of erosion control blocks can have a pattern that repeats, and thus can be longer and/or wider than shown. The mat 80 includes three different types of blocks, some with different thicknesses, and some with different arrangements of full and partial arms and sockets to provide an energy dissipation surface. It is understood that providing a block itself with an irregular upper surface does assist in dissipating the water energy by slowing down the velocity of the water to a certain extent. However, it is also well understood that if the irregularities in the surface of the block are too close together, then water stagnation can occur, in which event the lower areas simply contain stagnant water and the flowing water passes over the stagnant water without slowing down. According to the mat 80 of erosion control blocks shown in FIG. 15, the irregularities in the mat 80 comprise the different thickness blocks where the valleys and peaks are at least a block width apart, thereby reducing areas of stagnant water and providing a reduced velocity to the water flowing thereover. An additional benefit of the arrangement of erosion control blocks is that the hydraulic properties of the small thickness blocks is not compromised, as compared to the thicker and heavier blocks. Thicker and heavier erosion control blocks have a better hydraulic stability, as compared to thinner and lighter blocks. However, the thicker an erosion control block is, the more costly and the more burdensome it becomes to install by manual means. Thus, by using horizontal and vertical interlocking erosion control blocks of different thicknesses and with an arrangement of partial thickness arms and partial depth sockets, a cost effective mat is realized that is also less burdensome to install than the thicker blocks alone, and the hydraulic stability of the mat 80 is not compromised.

In one embodiment of the mat 80, four-inch thick interlocking blocks are employed, as well as eight-inch thick interlocking blocks. A nine-block matrix 84 constitutes six four-inch blocks and three eight-inch blocks. An eight-inch thick block 86 is located in the top row of the matrix 84, in the middle. The other two eight-inch thick blocks 88 and 90 of the matrix 84 are located in the third row, at the corners. Each eight-inch thick block 86-90 is of identical construction, with a pair of partial thickness arms 92 and 94, a partial depth socket 96 and a full socket 98, as identified with block 86. The partial thickness arms and the partial depth sockets of the three eight-inch blocks 86, 88 and 90 can be half the thickness of the respective blocks, and thus the same thickness as the neighbor four-inch blocks. The remainder of the blocks in the matrix 84 are four-inch thick interlocking blocks. However, the four-inch thick blocks of the matrix 84 are not of identical construction. Rather, there are two different types of four-inch interlocking blocks utilized in the matrix 84. In each type of four-inch thick block, the partial thickness arm and the partial depth socket are shown shaded for ease of understanding.

Erosion control blocks 100, 102 and 104 (connected by V-shaped broken line 112) are of a first type, and blocks 106, 108 and 110 (connected by V-shaped broken line 114) are of a second type. The erosion control blocks 100, 102 and 104 are each four inches thick and include two full thickness arms 116 and 118, a full socket 120 and a partial depth socket 122, as identified in block 100. The other type of four-inch blocks 106, 108 and 110 each include two full thickness sockets 124 and 126, a full thickness arm 128 and a partial thickness arm 130, as shown by block 106. The partial thickness arms and the partial depth sockets of the four-inch thick blocks can be half the thickness of the respective blocks.

The other matrix 132 of nine erosion control blocks is similarly arranged with three eight-inch thick blocks and six four-inch thick blocks. The matrix 132 is connected to the matrix 84. The two connected matrices 84 and 132 of the example can be installed in a flume where the water flow is in the direction of arrow 134. Another matrix can be connected in an interlocking manner to the bottom of the matrix 132, and yet other similar matrices can be connected to the left or right sides of the matrices 84 and 132.

With regard to the interlocking connections of the blocks of the matrix 84, the block 106, which is downstream from block 100, has a partial thickness arm 130 that fits under the partial depth socket 122 of the neighbor upstream block 100. Thus, the leading edge of the downstream block 106 is held down by the trailing edge of the block 100, and prevented from being lifted by the hydraulic action of flowing water. The eight inch block 86 has a partial thickness arm 94 that fits into the full depth socket 120 of the neighbor four-inch thick block 100. The eight-inch block 86 also has a partial depth socket 96 that vertically interlocks with a full thickness arm 136 of downstream four-inch block 104. It can be appreciated that a partial depth socket of an eight-inch thick block 86 can be four inches thick, and accommodates a full thickness arm 136 of a four-inch thick block 104. The downstream block 104 is vertically interlocked with the upstream block 86 in a manner much like the neighbor blocks 100 and 106 to prevent the hydraulic lifting of the blocks.

The last block in the first row of the matrix 84, namely the four-inch thick block 102, includes a four-inch full thickness arm 138 that engages within the eight-inch full depth socket 98 of the eight-inch neighbor block 86. The four-inch thick block 108, downstream from the upstream four-inch thick block 102, includes a partial thickness arm 140 that fits under the partial depth socket 142 of block 102. With this arrangement, each block 106, 104 and 108 in the second row of the matrix 84 has an arm that is vertically interlocked under the partial depth socket of a respective upstream block. This is the case even when all of the blocks in the first and second rows of the matrix 84 are four-inch thick blocks, except for the eight-inch thick block 86. Thus, water flow over the first two rows of the matrix 84 flows over an uneven surface to prevent stagnant water and to promote energy dissipation of the water by slowing it down.

Each four-inch block 106, 104 and 108 in the second row of the matrix 84 is interlocked together laterally with full arm and socket connections. The full socket 126 of the four-inch block 106 in the second row is interlocked with the partial thickness arm 144 of the downstream eight-inch block 88. The partial thickness arm 146 of the four-inch block 110 is interlocked under the partial depth socket 148 of the neighbor upstream block 104. The partial thickness arm 150 of the eight-inch block 90 is interlocked with the full depth socket 152 of the neighbor upstream four-inch block 108. In this situation, the downstream lighter weight four-inch block 110 is vertically interlocked under the neighbor upstream block 104, but the other two heavier eight-inch thick blocks 88 and 90 in the third row are not vertically interlocked with the neighbor upstream blocks, as the heavier eight-inch blocks 88 and 90 are hydraulically more stable than the lighter four-inch block 110, and do not require a vertical interlocking connection on the leading edges thereof.

The four-inch block 110 in the third row of the matrix 84 is interlocked with the neighbor eight-inch block 88 using respective full thickness arms and full depth sockets 154 and 156. The four-inch block 110 is also interlocked with the other neighbor eight-inch block 90 using a respective full depth socket 158 and partial thickness arm 160.

As noted above, the block arrangement of the first matrix 84 is repeated in the second matrix 132 of the mat 80. It is also noted that the downstream four-inch blocks 162 and 166 of the first row in the second matrix 132, are vertically interlocked with the respective neighbor upstream blocks 88 and 90. The exception for vertical interlocking in the first row of the second matrix 132 is the downstream eight-inch block 164. In this case, the heavier eight-inch block 164 is hydraulically more stable than the neighbor four-inch blocks by virtue of the heavier weight of such block 164. The analysis of the improved hydraulic stability of the second and third rows of blocks of the second matrix 132 is the same as set forth above in connection with the corresponding rows of blocks in the first matrix 84. It is generally necessary only to provide the leading edge of the downstream light-weight blocks in each column with vertical interlocking capabilities so that such leading edge does not tend to be lifted, which would allow water to flow under the block. The laterally located neighbor blocks in a row generally do not need to be provided with vertical interlocking capabilities. However, in all instances, it is preferred to provide all blocks in a mat with horizontal interlocking capabilities, both neighbor blocks in rows and columns.

In addition to the improved hydraulic stability of the mat 80 described above, the irregular surface of the mat 80 substantially reduces or eliminates stagnant water pockets in the mat 80. It can be seen from the mat 80 of FIG. 15 that the bold outline eight-inch blocks present an impediment to the downstream flow of water thereover. In each column of the mat 80, every fourth block is an eight-inch block, but staggered from the neighbor columns. In other words, and as can be seen in FIG. 15, each matrix 84 and 132, includes a first row with one eight-inch block, a second row with no eight-inch blocks, and a third row with two eight-inch blocks. Thus, each low elevation surface of the mat 80 is greater than the width a single block. The low elevation surface contour of the mat 80 is where the four-inch blocks are located.

In the direction of water flow 134, there are two four-inch blocks representing the low elevation surface between each eight-inch block. And the adjacent pair of four-inch blocks are staggered for each column in the mat 80 so that a continuous row of eight-inch blocks is not presented to the flow of water. Rather, the water must take a circuitous route down the irregular height blocks in a column of the mat 80, which thereby dissipates the velocity of the water and reduces the energy and the ability to hydraulically lift the erosion control blocks from the mat 80. With the arrangement of the three eight-inch blocks 88, 90 and 164, as water flows in the direction of arrow 134, there is imparted to the water flow a horizontal flow component that makes the overall flow more circuitous. For example, water flowing over the four-inch blocks 100 and 106 in the first column and over the four-inch blocks 102 and 108 in the third column of the mat 80, flows into the respective eight inch blocks 88 and 90, and then is funneled somewhat horizontally inwardly toward the center eight-inch block 164. Because of the arrangement of blocks of the mat 80, it is believed that optimum energy is dissipated for water flowing over the mat at a depth of about three to four feet.

Figure 16:
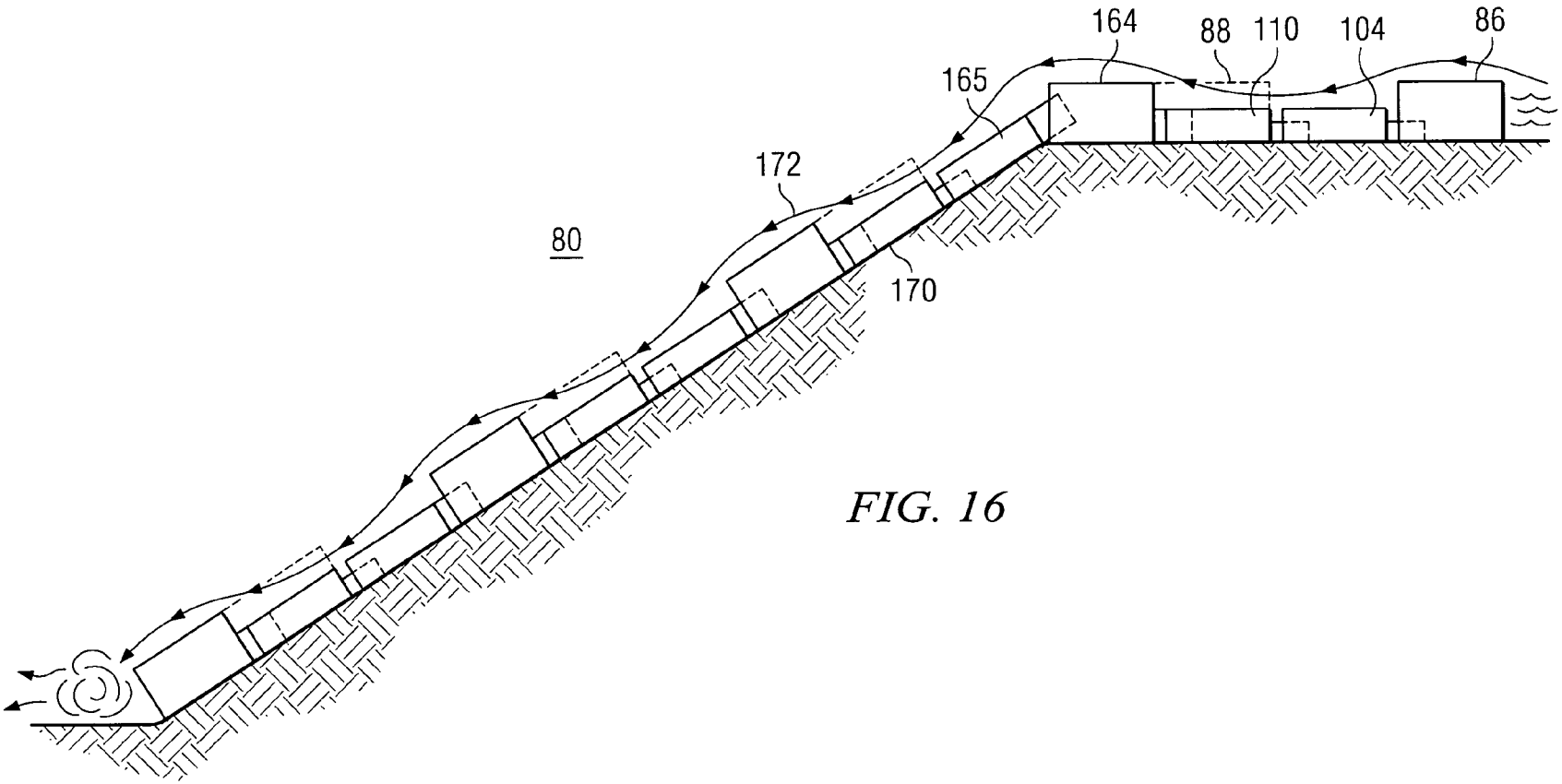
FIG. 16 is a side view of a flume over which the mat of FIG. 15 is installed.

FIG. 16 illustrates a side view of the mat 80 installed in a flume 170. Typical flumes are about four feet wide, with an incline length of about 30 feet to 120 feet, and with a 2:1 ratio of incline. The radius of curvature of the transitions between the upper and lower horizontal ground portions and the incline is about six feet. Of course, flumes of other dimensions can be employed for erosion protection with the blocks and techniques of the invention. Indeed, the blocks and arrangements illustrated herein are not limited to flumes, but can be used in many other situations to control erosion of soil, sand and the like.

The column of blocks illustrated in FIG. 16 is a side view of the second column of blocks shown in FIG. 15. The blocks in the illustrated column, as well as the blocks in each row are spaced apart somewhat from each other to allow flexibility and articulation of adjacent blocks to conform to the contour of the underlying ground, or woven geotextile on which the mat 80 is installed. In the event that the flexibility of the blocks is too limited to be'installed in an interlocking manner over the curved transition between the horizontal ground and the incline, then the appropriate blocks can be grouted together to maintain a rigid interconnection. The broken line 88 represents the eight-inch block of the first column of blocks shown in FIG. 15. The broken lines between the blocks of the column shown illustrate the nature of the arm and socket engagement. The blocks at the top horizontal portion of the flume 170 include the eight-inch block 86, and the two four-inch downstream blocks 104 and 110. The two four-inch blocks 104 and 110 are vertically interlocked to the respective neighbor upstream blocks 104 and 86. The water flows over the top of the first eight-inch block 86 and down onto the lower surface contour of the two four-inch blocks 104 and 110, and then up and over the top of the next eight-inch block 164. The water then proceeds down the incline of the flume 170 and encounters spaced apart eight-inch blocks that impede the water flow and dissipate the energy thereof. The arrowed line 172 in FIG. 16 depicts the circuitous up and down path taken by the water flowing over the irregular-surface mat 80. As noted above, the water flow down the flume 170 also takes a circuitous lateral route that snakes between different columns of blocks, which route also functions to reduce the stagnant water problem and dissipate the energy of the flowing water.

While the foregoing block types and arrangements are well adapted for providing a horizontal and vertical interlocking arrangement that vastly improves hydraulic stability and is cost effective, other arrangements and block types are possible and within the scope of the invention. Other configurations and arrangements of four-inch and eight inch blocks to form a mat can be realized which provide a different surface contour than that shown in FIG. 15. Moreover, blocks with thicknesses other than four inches and eight inches can be employed to achieve an irregular surface contour to dissipate the energy of the water flowing thereover.

Figure 17:
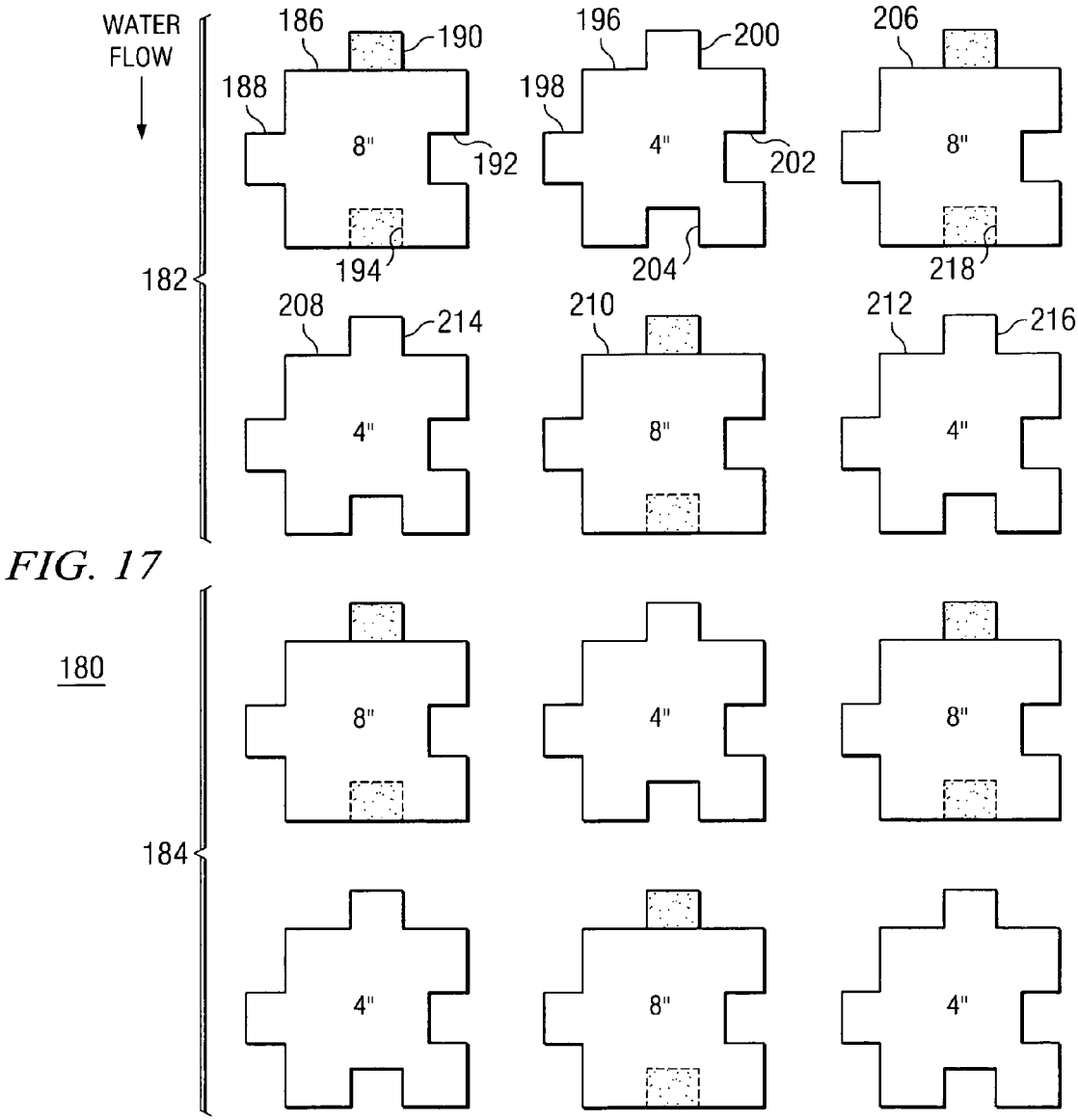
FIG. 17 is another embodiment of a mat of erosion control blocks employing different thickness blocks to provide energy dissipation to water flowing over the mat.

In accordance with another embodiment of the invention, illustrated in FIG. 17 is a mat 180 comprising a repeating matrix of erosion control blocks of different thicknesses to dissipate the energy of water flowing thereover. The first matrix 182 of six blocks is repeated as a second downstream matrix 184. In this arrangement, there are only two different types of blocks. One type of block 186 is eight inches thick and includes a full arm 188 and a partial thickness arm 190, and a full depth socket 192 and a partial depth socket 194. The other type of block 196 is four inches thick and includes a pair of full thickness arms 198 and 200, and a pair of full depth sockets 202 and 204. The four-inch block 196 can be an unmodified version of the block described in U.S. Pat. No. 5,556,228, as shown in FIG. 1 above.

There are three eight-inch blocks 186, 206 and 210 for each matrix 182 and 184. Similarly, there are three four-inch blocks 196, 208 and 212 for each matrix 182 and 184. The different type blocks are arranged symmetrically in the mat 180. Every other block in each row and in each column is either an eight-inch block or a four-inch block. The blocks of the same type occupy different positions in adjacent rows. In other words, the eight-inch blocks in the first row of matrix 182 occupy positions one and three, and in row two position two. The four-inch block in the first row of the matrix 182 occupies the second position and in the second row the four-inch blocks occupy the first and third positions.

Much like the matrix 84 of FIG. 15, the blocks of the matrix 180 of FIG. 17 are arranged so that each downstream four-inch block is vertically interlocked with a respective upstream block. For example, the downstream four-inch block 208 includes a full thickness arm 214 interlocked under the partial depth socket 194 of the upstream eight-inch blocks 186. Similarly, the downstream four-inch block 212 includes a full thickness arm 216 interlocked under the partial depth socket 218 of the upstream eight-inch blocks 206. Each downstream eight-inch block does not require a vertical interlocking connection with the respective upstream four-inch block, because the eight-inch thick blocks are heavier than the four-inch thick blocks and thus are hydraulically more stable. While this mat 180 of erosion control blocks is well adapted for dissipating the energy of water flowing thereover, such mat is adapted for use where the water depth is expected to be in the range of about one to two feet deep.

FIG. 18 illustrates another embodiment of a mat 220 of erosion control blocks adapted to provide horizontal and vertical interlocking, as well as reduction of the energy of the water flowing thereover. The mat 220 is shown with two nine-block matrices 222 and 224, it being realized that other similar matrices would be employed in practice to cover the ground surface of a specified area. The blocks of the mat 220 are installed on the ground to be protected from erosion, with the water flowing in the direction of arrow 226. The matrix 222 would be installed first, followed by the upstream matrix 224. In other words, if the mat 220 were to be installed in a flume, the row of blocks at the top of the matrix 222 shown in FIG. 18 would be installed first, and then the subsequent rows of blocks of the matrix 222 would be installed upstream therefrom.

In the embodiment of the mat 220, two different types of blocks are employed. In the nine-block matrix 222, as well as in the matrix 224, there are six 4.5 inch thick blocks 228, 230, 232, 240, 242 and 244 that are each constructed in a similar manner. Lastly, there are three 8.5 inch thick blocks 234, 236 and 238 that are each constructed in a similar manner. While not shown, the blocks of the matrices 222 and 224 are constructed like that of FIG. 9 with vegetation holes formed therethrough.

The 4.5 inch set of six blocks 228, 230, 232, 240, 242 and 244 each include one full thickness arms 246, a partial thickness arm 248, a full depth socket 250, and a partial depth socket 252, as shown by block 228. The 8.5 inch set of three blocks 234, 236 and 238 each include a full thickness arm 254, a partial thickness arm 256, a full depth socket 258 and a partial depth socket 260, as shown by block 234. Preferably, although not by way of necessity, the combined dimensions of a partial thickness arm and the thickness of the additional material 46 (FIG. 4) covering a partial depth socket of a block is about the same as the thickness of that block. In the preferred embodiment, the partial thickness of an arm 248 of the 4.5 inch block 228, is about 3.25 inches thick. The depth of the partial depth socket 252 of block 228 is about 3.25 inches, and the thickness of the additional material covering the socket 252 is about 1.25 inches thick. The other five blocks of the 4.5 inch set include the same type of partial thickness arms and partial depth sockets. The three 8.5 inch set of blocks 234, 236 and 238 each include a partial thickness arm about 7.25 inches thick, a partial depth socket of about 7.25 inches deep, with the thickness of the additional material covering the partial depth socket being about 1.25 inches thick. When installing the blocks of each matrix 222 and 224, the cavities of the partial depth sockets of each block face upwardly from the ground, and the partial thickness arms of the respective neighbor blocks are laid downwardly into the partial depth sockets. As noted above, the matrix 224 is similarly constructed with the same arrangement of nine erosion blocks.

The first row of blocks 242, 232 and 244 in the downstream matrix 222 is installed first on the ground to be protected from erosion, and downstream of the other matrices connected to the matrix 222. The block 242 is laid on the ground. The neighbor block 232 is laid adjacent the block 242 with the full thickness arm 284 interlocked with the full depth socket 286 of block 242. The block 244 is then laid on the ground with the full thickness arm 290 interlocked with full depth socket 292 of the neighbor block 232. The blocks 242, 232 and 244 of the first row of the matrix 222 can be installed in the reverse sequence. As will be described below, the other blocks of the matrix 222 are installed upstream, or up the grade of the flume.

Next, the partial thickness arm 284 of block 236 of the second row is laid down into the partial depth socket 282 of block 242. The full thickness arm 262 of block 240 is then interlocked with the full depth socket 278 of block 236, and at the same time the partial thickness arm 264 of the block 240 is laid down into the partial thickness arm 288 of block 232. The last block in row two of the matrix 222, namely block 238, is laid down so that the full thickness arm 280 interlocks with full depth socket 266 of block 240, and at the same time the partial thickness arm 296 is laid down into the partial depth socket 294 of block 244. The blocks 236, 240 and 238 of the second row can be installed in the reverse sequence.

With regard to the third row of the matrix 222, the block 228 is laid on the ground so that the full thickness arm 248 is laid down into the partial depth socket 272 of neighbor block 236. The next block 234 is then laid down on the ground so that the full thickness arm 254 interlocks with the full depth socket 250 of block 228, and at the same time the partial thickness arm 256 of block 234 is laid down into the partial depth socket 268 of block 240. Lastly, the third block 230 in the third row is laid on the ground so that the full thickness arm 270 interlocks with the full depth socket 258 of block 234, and at the same time the full thickness arm 276 of block 230 is laid down into the partial depth socket 274 of neighbor block 238. The blocks 228, 234 and 230 of the third row of matrix 222 can be installed in the reverse sequence.

As can be seen from the foregoing, the downstream arm of each block is laid down into the upstream socket of the downstream neighbor block to prevent hydraulic lifting of water flowing in the downstream direction, as indicated by arrow 226. The partial depth sockets of the downstream blocks of the matrix are thus vertically interlocked under the partial thickness arms of the upstream blocks. The hydraulic stability of the matrix 222 is thereby increased. The upstream matrix 224 can be installed in the same manner as the matrix 222 described above. In addition, other similar matrices can be installed to the right and the left of the matrix 222, as well as matrix 224, to form mats of desired areas. After a complete mat of blocks has been installed, the partial thickness arms and the partial depth sockets are undetectable to an observer. However, each block is nevertheless vertically interlocked and cannot be lifted out of the matrix of blocks.

It can be seen from the foregoing that the different types of mats of revetment blocks can be selected to form a mat. When installing the revetment blocks to form a mat, the specific block must be selected for a particular location in the mat. The blocks can be marked with an indicia during manufacture, or after manufacture, to uniquely identify the different types of blocks. For example, the three different types of blocks in the FIG. 15 mat could be molded so as to have the numeral "1", "2" and "3" on the top surface of the respective blocks to aid in selecting the blocks and in repeating the pattern of the blocks already installed. The numerals could be formed as part of the mold, or could be manually stamped thereon before the concrete in the mold has set. The indicia could also be spray painted on the completed blocks or applied in many other ways to visually differentiate the different types of blocks. As yet another method of making the different types of blocks visually different, the blocks could have a different color added to the concrete during mixing of the concrete. Yet other visually distinguishing marks can be applied to the different types of blocks by those skilled in the art.

The various embodiments of the erosion control blocks described above include features that facilitate the interlocking relationship between neighbor blocks, as well as features that dissipate the energy of water flowing thereover. It should be understood that the various features can be implemented without employing the particular shapes and sizes of the features. For example, the horizontal interlocking feature of the various blocks can be realized by using arms and sockets with other shapes and sizes. The thicknesses of the various blocks can be other than described above. In addition, the depth of both the arms and sockets of the vertically interlocking feature need not be half the thickness of the respective blocks. Rather, the thickness of a vertical interlocking arm of, for example, a four-inch thick block, can be three inches thick, the depth of a corresponding socket of a four-inch thick block can be one inch. Of course, other dimensions of the partial thickness arm and partial depth socket can be yet other dimensions adapted to address particular problems or issues.

While the erosion control blocks of the various embodiments are interlocking and cannot be radially removed from each other, such blocks can nevertheless include cable channels therethrough and be cabled together. The advantage of a cabled mat of blocks is that they can be assembled on level ground and cabled together, and then be lifted with a crane and installed in a river bed, or the like, which is full of water. The cable channels and the cabling of a mat of the blocks can be accomplished in a manner similar to that described in U.S. Pat. No. 6,276,870 by Smith, which is incorporated herein by reference.

While the preferred and other embodiments of the invention have been disclosed with reference to specific revetment blocks, and associated methods of construction and installation thereof, it is to be understood that many changes in detail may be made as a matter of engineering choices without departing from the spirit and scope of the invention, as defined by the appended claims.

What is claimed is:

1. A mat of three different types of interlocked revetment blocks, comprising:

a first type of revetment block having a body with a thickness defined by a distance between a top surface and a bottom surface of the body of said first type block, said first type block further including:

a plurality of side edges;

at least two arms, each arm extending from a respective side edge of the body of said first type block;

each said arm having an enlarged end connected to a respective side edge by a narrowed neck portion;

at least one said arm being a partial thickness arm having a thickness less than the thickness of the body of said first type block;

at least two sockets formed inwardly from respective side edges of the body of said first type block;

each said socket having an enlarged cavity connected by a narrowed inlet to the respective side edge of the body of said first type block, each said socket adapted for receiving therein an arm of a similarly constructed neighbor block;

at least one said socket being a partial depth socket having a thickness less than the thickness of the body of said first type block;

further including a second type block, said first type and second type block each having a first thickness, said first type block and said second type block having different configurations of arms and sockets;

a third type block having a thickness greater than the thickness of said first and second type blocks;

said first, second and third type blocks each having at least one of an arm or socket for interlocking with a respective socket or arm of a neighbor block of the mat; and a mat comprising a plurality of said first type blocks, a plurality of said second type blocks and a plurality of said third type blocks interlocked to form said mat.

2. The revetment block of claim 1, wherein said first type block includes only two said arms, where a first said arm is a full thickness arm and a second said arm is said partial thickness arm.

3. The revetment block of claim 1, wherein said first type block includes only two said sockets, where a first said socket is characterized with a full depth which extends from a top surface of the body of the first type block to a bottom surface of the body of the first type block, and a second said socket is said partial depth socket.

4. The revetment block of claim 3, wherein said partial depth socket of said first type block is formed with a depth greater than about one half the thickness of the body of said first type block.

5. The revetment block of claim 1, wherein said arms of said first block have radial axes orthogonal to each other.

6. The revetment block of claim 1, wherein said sockets of said first type block have radial axes orthogonal to each other.

7. The revetment block of claim 1, wherein said partial thickness arm of said first type block is formed with a thickness at least half the thickness of the body of said first type block.

8. The revetment block of claim 1, wherein said partial depth socket of said first type block includes material covering said partial depth socket to provide support with respect to an adjacent socket to reduce breakage of the first type block.

9. The revetment block of claim 8, wherein said first type block is octagonal shaped with four sides and four angled corners, and two said sockets are formed in adjacent sides of said first type block, and a portion of said first type block between the enlarged cavities of said two sockets defines an otherwise weak area that is strengthened by said material covering said partial depth socket.

10. The revetment block of claim 1, wherein said mat comprises a plurality of said first type blocks, and said first, second and third type blocks of said mat are installed in a specified manner as a function of a direction of flow of water thereover.

11. In a mat with a revetment block of the type having arms and sockets, a method of reinforcing the block, comprising:

forming said block of a heavy material;

forming only a pair of arms extending radially outwardly from respective side edges of a body of the block;

forming said arms with respective radial axes orthogonal to each other;

forming one said arm having a thickness about the same as a thickness of the body of said block;

forming at least one partial depth socket with a depth less than a thickness of the body of said block so that the heavy material covers said socket to a desired depth to thereby provide reinforcement to said at least one socket;

forming one said arm of said pair of arms as a partial thickness arm, said partial thickness arm having a thickness less than the thickness of the body of said block; and forming blocks of different thicknesses, including forming a first type block with a first thickness having at least one said partial thickness arm and at least one said partial depth socket, and forming a second type block having a thickness greater than the thickness of the first type block, said second type block having at least one of an arm or socket for interlocking with the respective partial thickness arm or partial depth socket of said first type block, and using plurality of first type blocks and a plurality of second type blocks interlocked together to form the mat.

12. The method of claim 11, further including forming said arms and said sockets of said first and second type blocks so as to be interlocking to prevent interlocked blocks of the mat from being radially removed from each other.

13. The method of claim 11, further including forming the mat of said first and second type blocks, where each block of the mat is identically constructed.

14. The method of claim 11, further including forming the first type blocks with a full depth socket adapted for receiving a partial thickness arm of the second type block, and forming the second type block with a partial depth socket to receive a full thickness arm of the first type block.

15. The method of claim 11, further including forming the second type block having a full thickness arm, a partial thickness arm, a full depth socket and a partial depth socket.

16. The method of claim 11, further including forming a third type block having a thickness greater than the thickness of the first and second type blocks, and using a plurality of first type blocks, a plurality of second type blocks and a plurality of third type blocks interlocked together to form the mat.

17. The method of claim 11, further including forming blocks with different configurations of arms and sockets, and placing a unique identification on each different type block to facilitate the selection thereof in forming the mat of said blocks.

18. In a mat with a revetment block of the type having arms and sockets, a method of reinforcing the block, comprising:

forming said block of a heavy material;

forming only a pair of arms extending radially outwardly from respective side edges of a body of the block;

forming said arms with respective radial axes orthogonal to each other;

forming one said arm having a thickness about the same as a thickness of the body of said block;

forming at least one partial depth socket with a depth less than a thickness of the body of said block so that the heavy material covers said socket to a desired depth to thereby provide reinforcement to said at least one said socket;

forming one said arm of said pair of arms as a partial thickness arm, said partial thickness arm having a thickness less than the thickness of the body of said block; and forming blocks of different thicknesses, including forming a first type block and a second type block, each said first type and second type block having a first thickness, said first type and second type blocks having different configurations of arms and sockets, and forming a third type block having a thickness greater than the thickness of the first and second type blocks, and using a plurality of first type blocks, a plurality of second type blocks and a plurality of third type blocks interlocked together to form the mat.

* * * * *